US011315514B2

(12) United States Patent
Wang et al.

(10) Patent No.: US 11,315,514 B2
(45) Date of Patent: Apr. 26, 2022

(54) DRIVER CIRCUIT AND DRIVING METHOD THEREOF

(71) Applicant: SHENZHEN CHINA STAR OPTOELECTRONICS SEMICONDUCTOR DISPLAY TECHNOLOGY CO., LTD., Guangdong (CN)

(72) Inventors: Haijun Wang, Guangdong (CN); Xin Zhang, Guangdong (CN); Miao Jiang, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 1 day.

(21) Appl. No.: 17/056,012

(22) PCT Filed: Oct. 23, 2020

(86) PCT No.: PCT/CN2020/123191

§ 371 (c)(1),
(2) Date: Nov. 17, 2020

(65) Prior Publication Data

US 2022/0068233 A1 Mar. 3, 2022

(30) Foreign Application Priority Data

Sep. 3, 2020 (CN) ..... 202010914378.8

(51) Int. Cl.
*G09G 3/36* (2006.01)

(52) U.S. Cl.
CPC ..... *G09G 3/3677* (2013.01); *G09G 3/3696* (2013.01); *G09G 2300/0426* (2013.01); *G09G 2360/14* (2013.01)

(58) Field of Classification Search
None
See application file for complete search history.

(56) References Cited

U.S. PATENT DOCUMENTS

| | | | | |
|---|---|---|---|---|
| 11,069,292 | B1 * | 7/2021 | Heganovic | G09G 3/3283 |
| 11,189,225 | B1 * | 11/2021 | Heganovic | G09G 3/3291 |
| 2009/0310007 | A1 | 12/2009 | Matsui et al. | |
| 2015/0041628 | A1 | 2/2015 | Goh et al. | |
| 2017/0269782 | A1 | 9/2017 | Wu | |
| 2019/0043401 | A1 | 2/2019 | Wang et al. | |

FOREIGN PATENT DOCUMENTS

| | | | |
|---|---|---|---|
| CN | 101543059 | A | 9/2009 |
| CN | 102063217 | A | 5/2011 |
| CN | 102207647 | A | 10/2011 |
| CN | 105044955 | A | 11/2015 |
| KR | 20100068740 | A | 6/2010 |

* cited by examiner

*Primary Examiner* — Daniel C Puentes
(74) *Attorney, Agent, or Firm* — The Roy Gross Law Firm, LLC; Roy Gross

(57) ABSTRACT

The present invention discloses a driver circuit and a driving method thereof including a first thin film transistor, a second thin film transistor, and a third thin film transistor. Increasing a photocurrent of the second thin film transistor, i.e., amplifying the photocurrent of the thin film transistor to a photosensitive thin film transistor, advantages enhancement of a signal intensity and a signal-noise ratio of the photocurrent read out by the read line to solve the issue of weak a photocurrent signal from the photosensitive display.

17 Claims, 5 Drawing Sheets

DRIVER CIRCUIT AND DRIVING METHOD THEREOF

FIELD OF INVENTION

The present invention relates to a field of display technologies, especially relates to a driver circuit and a driving method thereof.

BACKGROUND OF INVENTION

In display industries, a thin film transistor liquid crystal display (TFT-LCD) has characteristics of light weight, thinness, smallness, low power consumption, zero radiation, and low manufacturing cost, and therefore has extensive applications. To widen business and home functions of liquid crystal displays, a display is integrated with various functions such as color temperature detection, laser detection, and gas detection, which increase application occasions of the liquid crystal display. However, many integrated functions are in the new development stage, and there are still many processes and related designs that need to be improved to improve the performance of the liquid crystal display with various integrated functions.

In the conventional technologies, to achieve of the liquid crystal display laser position detection and timing signal read function, a laser sensitive sensor TFT (photosensitive TFT/sensitive TFT) and a switch TFT (scan signal TFT) with a timing control function are usually integrated. When a external light source irradiates the sensor TFT, the sensor TFT generates an induced current I, the switch TFT selects to switch on and off cyclically. The induced current I is followed with a cyclical readout to complete sensing and read of the light source. Accordingly, the readout signal finally will be transmitted to to the liquid crystal display to control variation of display of the liquid crystal display, which achieves a display function of the liquid crystal display function operated by laser.

With reference to FIG. 1, FIG. 1 is a schematic view of a driver circuit of a typical passive 2T1C structure provided in the prior art. The structure has laser sensing and signal reading functions. Specifically, the passive 2T1C structure comprises a first thin film transistor T1 and a second thin film transistor T2. The first thin film transistor T1 is a sensor TFT, and the second thin film transistor T2 is a switch TFT. A gate electrode of the first thin film transistor T1 is connected to a first scan signal line G1, a drain electrode thereof is connected to a power voltage VDD, and a source electrode thereof is connected to a drain electrode of the second thin film transistor T2. A gate electrode of the second thin film transistor T2 is connected to a second scan signal line Gn, a source electrode thereof is connected to a read line R. It should be explained that "passive" refers to incapability of amplifying a signal generated by the first thin film transistor T1. "2T1C" refers to two TFTs and one storage capacitor CST. Although the passive 2T1C structure can achieve a light source signal read function and a cyclical read-out function, the liquid crystal display fails to effectively identify and read out the signal because the induced current generated by the first thin film transistor T1 is less and a signal read out by a corresponding readout signal line is comparatively weak, which affects the display function of the liquid crystal display.

SUMMARY OF INVENTION

Technical Issue

An objective of the present invention is to provide a driver circuit and a driving method thereof to solve to solve the that technical issue that a light-generated current signal of a photosensitive TFT of the conventional passive 2T1C structure is less and causes the liquid crystal display to fail to effectively read the signal.

Technical Solution

For achievement of the above objective, the present invention provides a driver circuit, comprising: a first thin film transistor configured to induce a photocurrent and comprising a gate electrode connected to a first scan signal line and a drain electrode connected to a first power voltage; a second thin film transistor configured to amplify the photocurrent and comprising a gate electrode connected to a source electrode of the first thin film transistor and a drain electrode connected to a second power voltage; a third thin film transistor configured to control a reading timing of the photocurrent and comprising a gate electrode connected to a second scan signal line, a drain electrode connected to a source electrode of the second thin film transistor, and a source electrode connected to a read line; and a first storage capacitor comprising a terminal connected to the gate electrode of the first thin film transistor and another terminal connected to the source electrode of the first thin film transistor and the gate electrode of the second thin film transistor.

Furthermore, the driver circuit further comprises: a second storage capacitor comprising a terminal connected to the source electrode of the second thin film transistor and the drain electrode of the third thin film transistor and another terminal connected to a ground terminal.

Furthermore, the driver circuit further comprises: a fourth thin film transistor configured to reset the photocurrent and comprising a gate electrode connected to a reset signal line, a drain electrode connected to the another terminal of the first storage capacitor and the gate electrode of the second thin film transistor, and a source electrode connected to a third power voltage.

Furthermore, the driver circuit further comprises: a second storage capacitor comprising a terminal connected to the source electrode of the second thin film transistor and the drain electrode of the third thin film transistor and another terminal connected to a ground terminal.

Furthermore, the driver circuit further comprises that each of the first thin film transistor, the second thin film transistor, the third thin film transistor, and the fourth thin film transistor is one of a low temperature polysilicon thin film transistor, an oxide semiconductor thin film transistor, or an amorphous silicon thin film transistor.

Furthermore, the driver circuit further comprises that each of the first power voltage and the second power voltage ranges from −20 v to +20 v.

Furthermore, the driver circuit further comprises that the third power voltage ranges from −10 v to 0 v.

To achieve the above objective, the present invention also provides a a driving method comprising the above the driver circuit, the driving method comprises steps as follows:

an initial phase step comprising in a light environment, inputting a first scan signal to the gate electrode of the first thin film transistor, and applying the first power voltage to the drain electrode of the first thin film transistor to switch on the first thin film transistor to generate a photocurrent such that the photocurrent is branched and flows from the source electrode of the first thin film transistor to the first storage capacitor and the second thin film transistor, wherein the photocurrent the flowing to the second thin film transistor forms a switch-on voltage of the gate electrode of the second thin film transistor;

a photocurrent amplification phase step comprising applying the second power voltage to the drain electrode of the second thin film transistor such that the drain electrode of the second thin film transistor generates a leakage current and the leakage current is amplified and flows to the photocurrent of the second thin film transistor; and a photocurrent acquisition phase step comprising inputting a second scan signal to the gate electrode of the third thin film transistor, switching on the third thin film transistor, and switching off the first thin film transistor and the second thin film transistor such that a voltage of the first storage capacitor is released from the source electrode of the third thin film transistor and the read line reads the photocurrent flowing to the second thin film transistor.

Furthermore, the photocurrent amplification phase step further comprises generating an amplified voltage between the first thin film transistor and the second thin film transistor, and storing the amplified voltage in the second storage capacitor as a voltage of the drain electrode of the third thin film transistor when the photocurrent flowing to the second thin film transistor is amplified; and the photocurrent acquisition phase step further comprises releasing the amplified voltage of the second storage capacitor from the source electrode of the third thin film transistor.

Furthermore, after the photocurrent acquisition phase, the method further comprises:

a reset phase step comprising inputting a reset signal to a gate electrode of a fourth thin film transistor and applying the third power voltage to a source electrode of the fourth thin film transistor such that a drain electrode of the fourth thin film transistor pulls down a voltage of the source electrode of the first thin film transistor and the second thin film transistor is in a turn-off status.

Advantages

Compared to the conventional technology, the driver circuit and the driving method provided by the present invention, by adding a second thin film transistor (i.e., amplifier thin film transistor) to amplify a photocurrent of a first thin film transistor (.e., photosensitive thin film transistor), facilitates enhancement of a signal intensity and a high signal-noise ratio of a photocurrent read out by a read line such that the issue of less a photocurrent signal in the photosensitive display. Adding the second storage capacitor can lower a coupling effect of a second scan line to a terminal of a drain electrode of a third thin film transistor and improve stability of a photocurrent output. By adding a fourth thin film transistor, when the second thin film transistor is switched on, the fourth thin film transistor inputs a low voltage to the drain electrode of the fourth thin film transistor to lower a voltage of the source electrode of the first thin film transistor such that the second thin film transistor is unable to switch on, which further improves stability of output of each frame of the first thin film transistor.

DESCRIPTION OF DRAWINGS

Specific embodiments of the present invention are described in details with accompanying drawings as follows to make technical solutions and advantages of the present invention clear.

DETAILED DESCRIPTION OF PREFERRED EMBODIMENTS

The technical solution in the embodiment of the present invention will be clearly and completely described below with reference to the accompanying drawings in the embodiments of the present invention. Apparently, the described embodiments are merely some embodiments of the present invention instead of all embodiments. According to the embodiments in the present invention, all other embodiments obtained by those skilled in the art without making any creative effort shall fall within the protection scope of the present invention.

Embodiment 1

Figure 1:
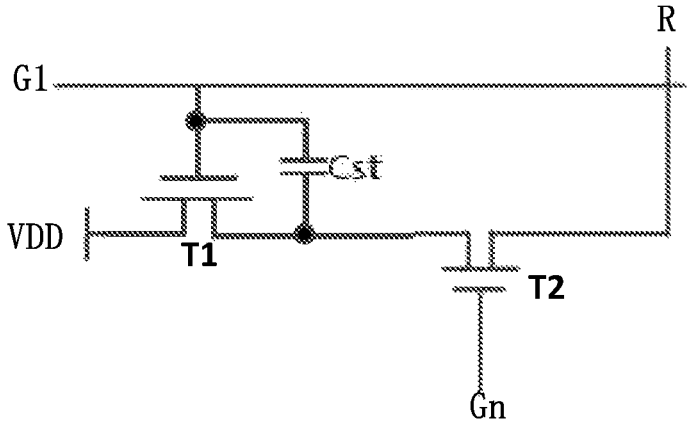
FIG. 1 PRIOR ART
FIG. 1 is a schematic view of a driver circuit of a typical passive 2T1C structure provided in the prior art.
Figure 2:
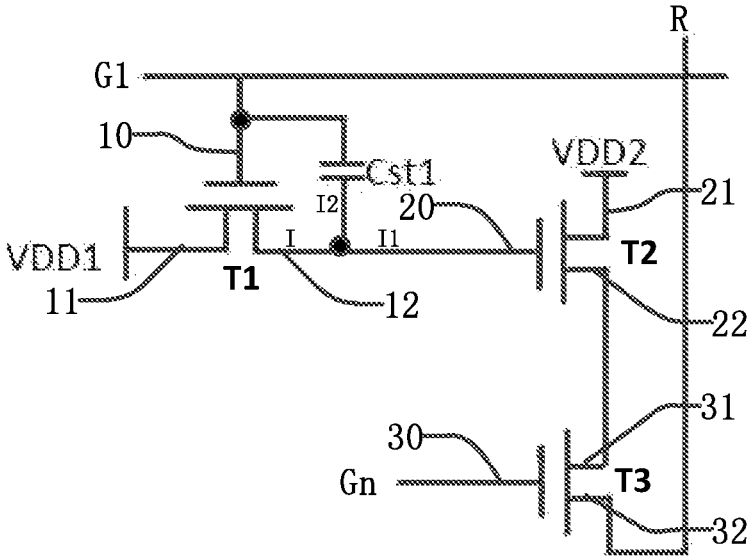
FIG. 2 is a schematic view of a driver circuit of an active 3T1C structure provided by an embodiment 1 of the present invention.

With reference to FIG. 2, FIG. 2 is a schematic view of a driver circuit of an active 3T1C structure, wherein "active" means capability of amplifying a photocurrent generated by a first thin film transistor TFT.

Specifically, the present embodiment provides a first driver circuit comprising a first thin film transistor T1, a second thin film transistor T2, a third thin film transistor T3, and a first storage capacitor Cst1.

The first thin film transistor T1 is configured to induce a photocurrent I, a gate electrode thereof is connected to a first scan signal line G1, and a drain electrode thereof is connected to a first power voltage, is configured to receive a light signal, and is connected to a first power voltage VDD1.

The second thin film transistor T2 is configured to amplify a photocurrent I1, a gate electrode thereof is connected to a source electrode of the first thin film transistor T1, and a drain electrode thereof is connected to a second power voltage VDD2.

The third thin film transistor T3 is configured to control read of the photocurrent I1, a gate electrode thereof is connected to a second scan signal line Gn, a drain electrode is connected to a source electrode of the second thin film transistor T2, and a source electrode is connected to a read line R (readout line).

The first storage capacitor Cst1 has one terminal connected to the gate electrode of the first thin film transistor T1 and another terminal connected to the source electrode of the first thin film transistor T1 and the gate electrode of the second thin film transistor T2.

In the present embodiment, each of the first power voltage VDD1 and the second power voltage VDD2 ranges from −20 v to +20 v. Each of the first thin film transistor T1, the second thin film transistor T2, and the third thin film transistor T3 is one of a low temperature polysilicon thin film transistor, an oxide semiconductor thin film transistor, or an amorphous silicon thin film transistor.

The present embodiment also provides a first driving method comprising the driver circuit as described above. the driving method comprises steps S11)-S13) as follows.

The step S11), an initial phase step, comprises in a light environment, with reference to FIG. 2, inputting a first scan signal to the gate electrode of the first thin film transistor T1, applying to the first power voltage VDD1 the drain electrode 11 of the first thin film transistor T1 to switch on the first thin film transistor T1 to generate a photocurrent I such that the photocurrent I is branched and flows from the source electrode 12 of first thin film transistor T1 to the first storage capacitor Cst1 and the second thin film transistor T2. The photocurrent I1 the flowing to the second thin film transistor T2 forms a switch-on voltage of the gate electrode 20 of the second thin film transistor T2, and the photocurrent I2 flowing to the first storage capacitor Cst1 is stored in the first storage capacitor Cst1 to form an electrical energy configured to charge the first thin film transistor T1.

In the present embodiment, the first power voltage VDD1 ranges from −20 v to +20 v. Specifically, the first power voltage VDD1, for example, 4 to 6 v, is constantly applied to the drain electrode 11 of the first thin film transistor T1 such that the first thin film transistor T1 is switched on constantly. Furthermore, the induced photocurrent I is generated by the first thin film transistor T1 and is branched and flows to the first storage capacitor Cst1 and the second thin film transistor T2.

The step S12), a photocurrent amplification phase, comprises applying a second power voltage VDD2 to the drain electrode 21 of the second thin film transistor T2, such that the drain electrode 21 of the second thin film transistor T2 generates a leakage current and the leakage current is amplified and flows to the photocurrent I1 of the second thin film transistor T2.

In the present embodiment, the second power voltage VDD2 ranges from −20 v to +20 v. Specifically, the second power voltage VDD2, for example, 8 to 10 v, is constantly applied to the drain electrode 21 of the second thin film transistor T2 such that the second thin film transistor T2 is switched on constantly. Furthermore, the drain electrode 21 thereof generates a leakage current to amplify the photocurrent I1 flowing to the second thin film transistor T2 to achieve amplification of electrical signals of the first thin film transistor T1.

It should be explained that in the present embodiment, when the photocurrent I1 flowing to the second thin film transistor T2 is amplified, an amplified voltage generated between the first thin film transistor T1 and the second thin film transistor T2 serves as an input voltage of the drain electrode 30 of the third thin film transistor T3.

The step S13), a photocurrent acquisition phase, comprises inputting a second scan signal to the gate electrode 30 of the third thin film transistor T3, switching on the third thin film transistor T3, switching off the first thin film transistor T1 and the second thin film transistor T2 such that a voltage of the first storage capacitor Cst1 is released from the source electrode 32 of the third thin film transistor T3 and the read line R reads the photocurrent I1 flowing to the second thin film transistor T2.

The present embodiment provides a first driver circuit and a driving method thereof, by increasing the second thin film transistor (i.e., amplifier thin film transistor) to amplify the photocurrent of the first thin film transistor (i.e., photosensitive thin film transistor), facilitates signal intensity of a photocurrent read out by the read line and a high signal-noise ratio such that the issue of less a photocurrent signal in the photosensitive display.

Embodiment 2

The present embodiment provides a second driver circuit and a driving method thereof comprising all technical solutions of the embodiment 1, further comprising a second storage capacitor Cst2.

Figure 3:
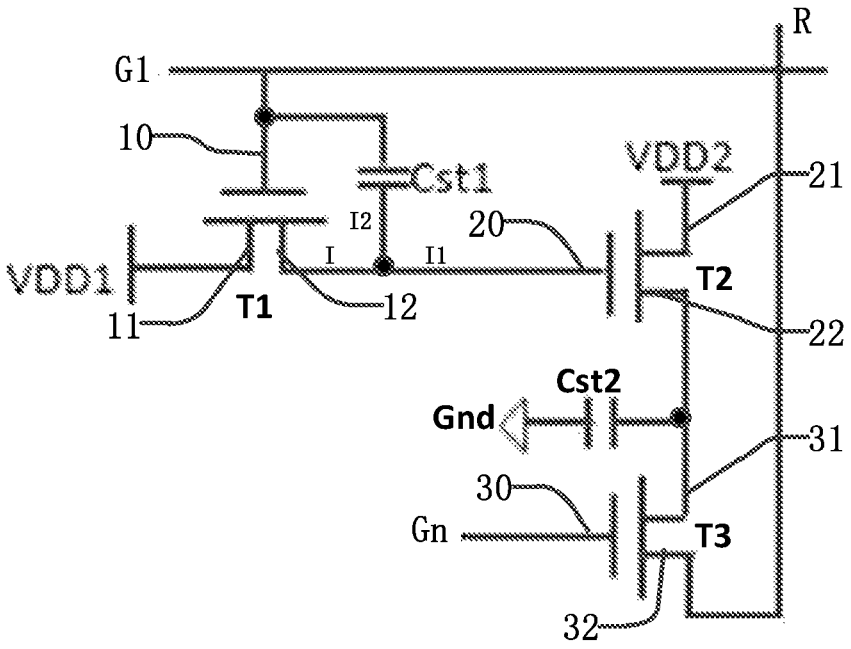
FIG. 3 is a schematic view of a driver circuit of an active 3T2C structure provided by an embodiment 2 of the present invention.

With reference to FIG. 3, FIG. 3 is a schematic view of a driver circuit of an active 3T2C structure. Specifically, the second driver circuit further comprises a second storage capacitor Cst2 comprising a terminal connected to the source electrode 22 of the second thin film transistor T2 and the drain electrode 31 of the third thin film transistor T3 and another terminal connected to a ground terminal Gnd. The present embodiment, by adding the second storage capacitor Cst2, can lower a coupling effect of the second scan line Gn to the drain electrode 31 of the third thin film transistor T3 to improve stability of output of the photocurrent I1 to guarantee stability of a photocurrent signal, which facilitates enhancement of signal intensity read by the read line.

The present embodiment also provides a second driving method, comprising a second driver circuit. The driving method comprises steps S21) to S23) as follows.

The step S21), an initial phase step, comprises in a light environment, with reference to FIG. 3, inputting a first scan signal to the gate electrode of the first thin film transistor T1, applying to the first power voltage VDD1 the drain electrode 11 of the first thin film transistor T1 to switch on the first thin film transistor T1 to generate a photocurrent I such that the photocurrent I is branched and flows from the source electrode 12 of first thin film transistor T1 to the first storage capacitor Cst1 and the second thin film transistor T2. The photocurrent I1 the flowing to the second thin film transistor T2 forms a switch-on voltage of the gate electrode 20 of the second thin film transistor T2, and the photocurrent I2 flowing to the first storage capacitor Cst1 is stored in the first storage capacitor Cst1 to form an electrical energy configured to charge the first thin film transistor T1.

In the present embodiment, the first power voltage VDD1 ranges from −20 v to +20 v. Specifically, the first power voltage VDD1, for example, 4 to 6 v, is constantly applied to the drain electrode 11 of the first thin film transistor T1 such that the first thin film transistor T1 is switched on constantly. Furthermore, the induced photocurrent I is generated by the first thin film transistor T1 and is branched and flows to the first storage capacitor Cst1 and the second thin film transistor T2.

The step S22), a photocurrent amplification phase, comprises applying a second power voltage VDD2 to the drain electrode 21 of the second thin film transistor T2, such that the drain electrode 21 of the second thin film transistor T2 generates a leakage current and the leakage current is amplified and flows to the photocurrent I1 of the second thin film transistor T2.

In the present embodiment, the second power voltage VDD2 ranges from −20 v to +20 v. Specifically, the second power voltage VDD2, for example, 8 to 10 v, is constantly applied to the drain electrode 21 of the second thin film transistor T2 such that the second thin film transistor T2 is switched on constantly. Furthermore, the drain electrode 21 thereof generates a leakage current to amplify the photocurrent I1 flowing to the second thin film transistor T2 to achieve amplification of electrical signals of the first thin film transistor T1.

It should be explained that in the present embodiment, when the photocurrent I1 flowing to the second thin film transistor T2 is amplified, an amplified voltage generated between the first thin film transistor T1 and the second thin film transistor T2 is stored in the second storage capacitor Cst2 and serves as a voltage of the drain electrode 30 of the third thin film transistor T3.

The step S23), a photocurrent acquisition phase, comprises inputting a second scan signal to the gate electrode 30 of the third thin film transistor T3, switching on the third thin film transistor T3, switching off the first thin film transistor T1 and the second thin film transistor T2 such that a voltage of the first storage capacitor Cst1 and a voltage of the second storage capacitor Cst2 are released from the source electrode 32 of the third thin film transistor T3 and the read line R reads the photocurrent I1 flowing to the second thin film transistor T2.

The present embodiment provides a second driver circuit and a driving method thereof, by increasing the second thin film transistor (i.e., amplifier thin film transistor) to amplify the photocurrent of the first thin film transistor (i.e., photosensitive thin film transistor), facilitates signal intensity of a photocurrent read out by the read line and a high signal-noise ratio such that the issue of less a photocurrent signal in the photosensitive display. In another aspect, adding the second storage capacitor can lower a coupling effect of a second scan line Gn to a terminal of a drain electrode of a third thin film transistor and improve stability of a photocurrent output such that stability of a photocurrent signal is guaranteed to further enhance signal intensity of a photocurrent read out by the read line and a high signal-noise ratio.

Embodiment 3

The present embodiment provides a third driver circuit and a driving method thereof, comprising all of technical solutions of the embodiment 1, further comprises fourth thin film transistor T4.

Figure 4:
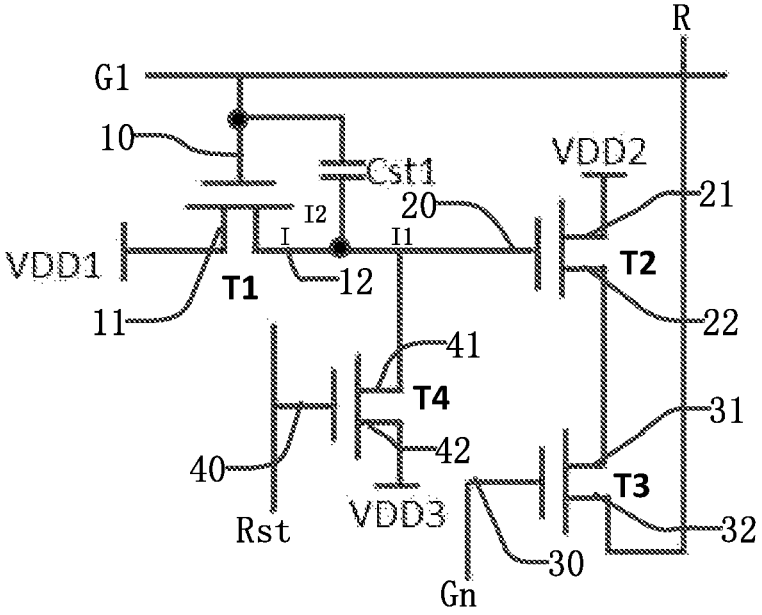
FIG. 4 is a schematic view of a driver circuit of an active 4T1C structure provided by an embodiment 3 of the present invention.

With reference to FIG. 4, FIG. 4 is a schematic view of a driver circuit of an active 4T1C structure. Specifically, the third driver circuit further comprises a fourth thin film transistor T4 configured to reset the photocurrent I1 and comprising a gate electrode 40 connected to a reset signal line Rst, a drain electrode 41 connected to another terminal of the first storage capacitor Cst1 and the gate electrode 20 of second thin film transistor T2, and a source electrode 42 connected to a third power voltage VDD3.

Because when the third thin film transistor T3 is switched on, irradiation of ambient light (i.e., noise signal) on first thin film transistor T1 constantly increases a voltage of source electrode 12 of the first thin film transistor T1 and such voltage is a noise voltage, i.e., instead of a photocurrent signal voltage required. To avoid the voltage from flowing in the second thin film transistor T2, the present embodiment adds the fourth thin film transistor T4. When the second thin film transistor T2 is switched on, the fourth thin film transistor T4 inputs a reset signal to the reset signal line Rst, and simultaneously inputs a third power voltage VDD3 to the source electrode 42 of the fourth thin film transistor T4 such that the fourth thin film transistor T4 is switched on, a voltage of the drain electrode 41 of the fourth thin film transistor T4 is pulled down, and a voltage of the source electrode 12 of the first thin film transistor T1 is pulled down through the voltage of drain electrode 41 of the fourth thin film transistor T4 to make the second thin film transistor T2 unable to be switched on. In summary, when the fourth thin film transistor T4 is switched on, irradiation of the ambient light on the first thin film transistor T1 pulls down the voltage of the source electrode 12 of the first thin film transistor T1 such that the second thin film transistor T2 is switched off.

In the present embodiment, the third power voltage VDD3 ranges from −10 v to 0 v. Specifically, the second thin film transistor T2, when switched on, inputs a reset signal is inputted to the reset signal line Rst, and simultaneously inputs a third power voltage VDD3 of −8 v or −5 v to the source electrode 32 of the fourth thin film transistor T4 such that the voltage of the drain electrode 31 of the fourth thin film transistor T4 can be pulled down by −8 v or −5 v to make the second thin film transistor T2 unable to be switched on, which further improves stability of each frame of the first thin film transistor T1.

The present embodiment also provides a first driving method comprising the driver circuit as described above. The driving method comprises steps S31)-S34) as follows.

The step S31), an initial phase step, comprises in a light environment, with reference to FIG. 4, inputting a first scan signal to the gate electrode of the first thin film transistor T1, applying to the first power voltage VDD1 the drain electrode 11 of the first thin film transistor T1 to switch on the first thin film transistor T1 to generate a photocurrent I such that the photocurrent I is branched and flows from the source electrode 12 of first thin film transistor T1 to the first storage capacitor Cst1 and the second thin film transistor T2. The photocurrent I1 the flowing to the second thin film transistor T2 forms a switch-on voltage of the gate electrode 20 of the second thin film transistor T2, and the photocurrent I2 flowing to the first storage capacitor Cst1 is stored in the first storage capacitor Cst1 to form an electrical energy configured to charge the first thin film transistor T1.

In the present embodiment, the first power voltage VDD1 ranges from −20 v to +20 v. Specifically, the first power voltage VDD1, for example, 4 to 6 v, is constantly applied to the drain electrode 11 of the first thin film transistor T1 such that the first thin film transistor T1 is switched on constantly. Furthermore, the induced photocurrent I is generated by the first thin film transistor T1 and is branched and flows to the first storage capacitor Cst1 and the second thin film transistor T2.

The step S32), a photocurrent amplification phase, comprises applying a second power voltage VDD2 to the drain electrode 21 of the second thin film transistor T2, such that the drain electrode 21 of the second thin film transistor T2 generates a leakage current and the leakage current is amplified and flows to the photocurrent I1 of the second thin film transistor T2.

In the present embodiment, the second power voltage VDD2 ranges from −20 v to +20 v. Specifically, the second power voltage VDD2, for example, 8 to 10 v, is constantly applied to the drain electrode 21 of the second thin film transistor T2 such that the second thin film transistor T2 is switched on constantly. Furthermore, the drain electrode 21 thereof generates a leakage current to amplify the photocurrent I1 flowing to the second thin film transistor T2 to achieve amplification of electrical signals of the first thin film transistor T1.

It should be explained that in the present embodiment, when the photocurrent I1 flowing to the second thin film transistor T2 is amplified, an amplified voltage generated between the first thin film transistor T1 and the second thin film transistor T2 serves as an input voltage of the drain electrode 30 of the third thin film transistor T3.

The step S33), a photocurrent acquisition phase, comprises inputting a second scan signal to the gate electrode 30 of the third thin film transistor T3, switching on the third thin film transistor T3, switching off the first thin film transistor T1 and the second thin film transistor T2 such that a voltage of the first storage capacitor Cst1 is released from the source electrode 32 of the third thin film transistor T3 and the read line R reads the photocurrent I1 flowing to the second thin film transistor T2.

The step S34), a reset phase step, comprises inputting a reset signal to the gate electrode 40 of the fourth thin film transistor T4, and applying the third power voltage to the source electrode of the fourth thin film transistor such that the drain electrode of the fourth thin film transistor pulls down a voltage of the source electrode of the first thin film transistor and the second thin film transistor is switched off.

Specifically, in the present embodiment, third power voltage VDD3 ranges from −10 v to 0 v. Specifically, the third thin film transistor T, when switched on, inputs a reset signal to the reset signal line Rst, and simultaneously inputs a third power voltage VDD3 of −8 v or −5 v to the source electrode 32 of the fourth thin film transistor T4 such that a voltage of the drain electrode 31 of the fourth thin film transistor T4 can be pulled down by −8 v or −5 v to make the second thin film transistor T2 unable to be switched on, which further improves stability of output of each frame of the first thin film transistor T1.

The present embodiment provides a third driver circuit and a driving method thereof. In one aspect, increasing the second thin film transistor (i.e., amplifier thin film transistor) to amplify the photocurrent of the first thin film transistor (i.e., photosensitive thin film transistor) facilitates signal intensity of a photocurrent read out by the read line and a high signal-noise ratio such that the issue of less a photocurrent signal in the photosensitive display. In another aspect, the fourth thin film transistor (i.e., reset thin film transistor) is added, and the second thin film transistor, when switched on, inputs a low voltage to the drain electrode of the fourth thin film transistor to lower a voltage of the source electrode of the first thin film transistor to make the second thin film transistor unable to be switched on, which further improves stability of output of each frame of the first thin film transistor T1.

Embodiment 4

The present embodiment provides a fourth driver circuit and a driving method thereof, comprising all technical solutions of the of the embodiment 2, and further comprises a fourth thin film transistor T4.

Figure 5:
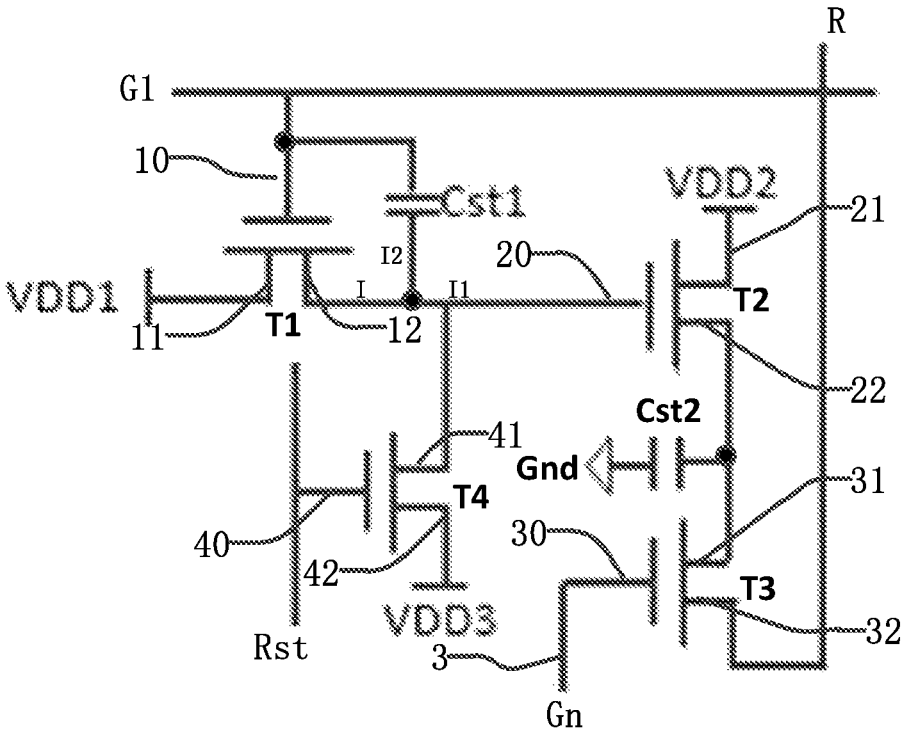
FIG. 5 is a schematic view of a driver circuit of an active 4T2C structure provided by an embodiment 4 of the present invention.

With reference to FIG. 5, FIG. 5 shows a driver circuit of an active 4T2C structure. Specifically, the fourth driver circuit further comprises a fourth thin film transistor T4 configured to reset the photocurrent I1 and comprising a gate electrode 40 connected to a reset signal line Rst, a drain electrode 41 connected to another terminal of the first storage capacitor Cst1 and the gate electrode 20 of the second thin film transistor T2, and a source electrode 42 connected to the third power voltage VDD3.

Because when the third thin film transistor T3 is switched on, irradiation of ambient light (i.e., noise signal) on first thin film transistor T1 constantly increases a voltage of source electrode 12 of the first thin film transistor T1 and such voltage is a noise voltage, i.e., instead of a photocurrent signal voltage required. To avoid the voltage from flowing in the second thin film transistor T2, the present embodiment adds the fourth thin film transistor T4. When the second thin film transistor T2 is switched on, the fourth thin film transistor T4 inputs a reset signal to the reset signal line Rst, and simultaneously inputs a third power voltage VDD3 to the source electrode 42 of the fourth thin film transistor T4 such that the fourth thin film transistor T4 is switched on, a voltage of the drain electrode 41 of the fourth thin film transistor T4 is pulled down, and a voltage of the source electrode 12 of the first thin film transistor T1 is pulled down through the voltage of drain electrode 41 of the fourth thin film transistor T4 to make the second thin film transistor T2 unable to be switched on. In summary, when the fourth thin film transistor T4 is switched on, irradiation of the ambient light on the first thin film transistor T1 pulls down the voltage of the source electrode 12 of the first thin film transistor T1 such that the second thin film transistor T2 is switched off.

In the present embodiment, the third power voltage VDD3 ranges from −10 v to 0 v. Specifically, the second thin film transistor T2, when switched on, inputs a reset signal is inputted to the reset signal line Rst, and simultaneously inputs a third power voltage VDD3 of −8 v or −5 v to the source electrode 32 of the fourth thin film transistor T4 such that the voltage of the drain electrode 31 of the fourth thin film transistor T4 can be pulled down by −8 v or −5 v to make the second thin film transistor T2 unable to be switched on, which further improves stability of each frame of the first thin film transistor T1.

The present embodiment also provides a first driving method comprising the driver circuit as describe above. The driving method comprises steps S41)-S44) as follows.

The step S41), an initial phase step, comprises in a light environment, with reference to FIG. 5, inputting a first scan signal to the gate electrode of the first thin film transistor T1, applying to the first power voltage VDD1 the drain electrode 11 of the first thin film transistor T1 to switch on the first thin film transistor T1 to generate a photocurrent I such that the photocurrent I is branched and flows from the source electrode 12 of first thin film transistor T1 to the first storage capacitor Cst1 and the second thin film transistor T2. The photocurrent I1 the flowing to the second thin film transistor T2 forms a switch-on voltage of the gate electrode 20 of the second thin film transistor T2, and the photocurrent I2 flowing to the first storage capacitor Cst1 is stored in the first storage capacitor Cst1 to form an electrical energy configured to charge the first thin film transistor T1.

In the present embodiment, the first power voltage VDD1 ranges from −20 v to +20 v. Specifically, the first power voltage VDD1, for example, 4 to 6 v, is constantly applied to the drain electrode 11 of the first thin film transistor T1 such that the first thin film transistor T1 is switched on constantly. Furthermore, the induced photocurrent I is generated by the first thin film transistor T1 and is branched and flows to the first storage capacitor Cst1 and the second thin film transistor T2.

The step S42) a photocurrent amplification phase, comprises applying a second power voltage VDD2 to the drain electrode 21 of the second thin film transistor T2, such that the drain electrode 21 of the second thin film transistor T2 generates a leakage current and the leakage current is amplified and flows to the photocurrent I1 of the second thin film transistor T2.

In the present embodiment, the second power voltage VDD2 ranges from −20 v to +20 v. Specifically, the second power voltage VDD2, for example, 8 to 10 v, is constantly applied to the drain electrode 21 of the second thin film transistor T2 such that the second thin film transistor T2 is switched on constantly. Furthermore, the drain electrode 21 thereof generates a leakage current to amplify the photocurrent I1 flowing to the second thin film transistor T2 to achieve amplification of electrical signals of the first thin film transistor T1.

It should be explained that in the present embodiment, when the photocurrent I1 flowing to the second thin film transistor T2 is amplified, an amplified voltage generated between the first thin film transistor T1 and the second thin film transistor T2 is stored in the second storage capacitor Cst2 and serves as a voltage of the drain electrode 30 of the third thin film transistor T3.

The step S43), a photocurrent acquisition phase, comprises inputting a second scan signal to the gate electrode 30 of the third thin film transistor T3, switching on the third thin film transistor T3, switching off the first thin film transistor T1 and the second thin film transistor T2 such that a voltage of the first storage capacitor Cst1 and a voltage of the second storage capacitor Cst2 are released from the source electrode 32 of the third thin film transistor T3 and the read line R reads the photocurrent I1 flowing to the second thin film transistor T2.

The step S44), a reset phase step, comprises inputting a reset signal to the gate electrode 40 of the fourth thin film transistor T4, and applying the third power voltage to the source electrode of the fourth thin film transistor such that the drain electrode of the fourth thin film transistor pulls down a voltage of the source electrode of the first thin film transistor and the second thin film transistor is switched off.

Specifically, in the present embodiment, third power voltage VDD3 ranges from −10 v to 0 v. Specifically, the third thin film transistor T, when switched on, inputs a reset signal to the reset signal line Rst, and simultaneously inputs a third power voltage VDD3 of −8 v or −5 v to the source electrode 32 of the fourth thin film transistor T4 such that a voltage of the drain electrode 31 of the fourth thin film transistor T4 can be pulled down by −8 v or −5 v to make the second thin film transistor T2 unable to be switched on, which further improves stability of output of each frame of the first thin film transistor T1.

The present embodiment provides a fourth driver circuit and a driving method thereof, first by increasing the second thin film transistor (i.e., amplifier thin film transistor) to amplify the photocurrent of the first thin film transistor (i.e., photosensitive thin film transistor), facilitates signal intensity of a photocurrent read out by the read line and a high signal-noise ratio such that the issue of less a photocurrent signal in the photosensitive display. Second, adding the second storage capacitor can reduce a coupling effect of the second scan line to the third thin film transistor drain electrode to improve stability of output of a photocurrent to guarantee stability of a photocurrent signal, which facilitates enhancement of signal intensity read by the read line. Finally, the fourth thin film transistor (i.e., reset thin film transistor) is added, when the second thin film transistor is switched on, the fourth thin film transistor inputs a low voltage to the drain electrode of the fourth thin film transistor to lower a voltage of the source electrode of the first thin film transistor to make the second thin film transistor unable to be switched on, which further improves stability of output of each frame of the first thin film transistor.

The present invention provides a driver circuit and a driving method thereof, excepts the above technical solutions of the embodiments of 3T1C, 3T2C, 4T1C, 4T2C, which can also implement multi-level amplification on the driver circuit, i.e., adding more second thin film transistors, fourth thin film transistors, and storage capacitors up to a structure of 5T1C, 5T2C, 5T3C, 6T1C, 6T2C, 6T3C, which will not be described repeatedly as long as amplification effect and outputted signal intensity of a photocurrent of the photosensitive transistor can be improved.

In the above-mentioned embodiments, the descriptions of the various embodiments are focused. For the details of the embodiments not described, reference may be made to the related descriptions of the other embodiments.

The driver circuit and the driving method thereof provided by the embodiment of the present invention are described in detail as above. The principles and implementations of the present application are described in the following by using specific examples. The description of the above embodiments is only for assisting understanding of the technical solutions of the present application and the core ideas thereof. Those of ordinary skill in the art should understand that they can still modify the technical solutions described in the foregoing embodiments are or equivalently replace some of the technical features. These modifications or replacements do not depart from the essence of the technical solutions of the embodiments of the present application.

What is claimed is:

1. A driver circuit, comprising:

a first thin film transistor configured to induce a photocurrent and comprising a gate electrode connected to a first scan signal line and a drain electrode connected to a first power voltage;

a second thin film transistor configured to amplify the photocurrent and comprising a gate electrode connected to a source electrode of the first thin film transistor and a drain electrode connected to a second power voltage;

a third thin film transistor configured to control a reading timing of the photocurrent and comprising a gate electrode connected to a second scan signal line, a drain electrode connected to a source electrode of the second thin film transistor, and a source electrode connected to a read line; and a first storage capacitor comprising a terminal connected to the gate electrode of the first thin film transistor and another terminal connected to the source electrode of the first thin film transistor and the gate electrode of the second thin film transistor.

2. The driver circuit as claimed in claim 1 further comprising:

a second storage capacitor comprising a terminal connected to the source electrode of the second thin film transistor and the drain electrode of the third thin film transistor and another terminal connected to a ground terminal.

3. The driver circuit as claimed in claim 1 further comprising:

a fourth thin film transistor configured to reset the photocurrent and comprising a gate electrode connected to a reset signal line, a drain electrode connected to the another terminal of the first storage capacitor and the gate electrode of the second thin film transistor, and a source electrode connected to a third power voltage.

4. The driver circuit as claimed in claim 3 further comprising:

a second storage capacitor comprising a terminal connected to the source electrode of the second thin film transistor and the drain electrode of the third thin film transistor and another terminal connected to a ground terminal.

5. The driver circuit as claimed in claim 3, wherein each of the first thin film transistor, the second thin film transistor, the third thin film transistor, and the fourth thin film transistor is one of a low temperature polysilicon thin film transistor, an oxide semiconductor thin film transistor, or an amorphous silicon thin film transistor.

6. The driver circuit as claimed in claim 3, wherein the third power voltage ranges from −10 v to 0 v.

7. The driver circuit as claimed in claim 1, wherein each of the first power voltage and the second power voltage ranges from −20 v to +20 v.

8. A driver circuit driving method for the driver circuit as claimed in claim 1, wherein the driver circuit driving method comprises:

an initial phase step comprising in a light environment, inputting a first scan signal to the gate electrode of the first thin film transistor, and applying the first power voltage to the drain electrode of the first thin film transistor to switch on the first thin film transistor to generate a photocurrent such that the photocurrent flows from the source electrode of the first thin film transistor to the first storage capacitor and the second thin film transistor, wherein the photocurrent the flowing to the second thin film transistor forms a switch-on voltage of the gate electrode of the second thin film transistor;

a photocurrent amplification phase step comprising applying the second power voltage to the drain electrode of the second thin film transistor such that the drain electrode of the second thin film transistor generates a leakage current and the leakage current is amplified and flows to the photocurrent of the second thin film transistor; and a photocurrent acquisition phase step comprising inputting a second scan signal to the gate electrode of the third thin film transistor, switching on the third thin film transistor, and switching off the first thin film transistor and the second thin film transistor such that a voltage of the first storage capacitor is released from the source electrode of the third thin film transistor and the read line reads the photocurrent flowing to the second thin film transistor.

9. The driver circuit driving method as claimed in claim 8, wherein the photocurrent amplification phase step further comprises generating an amplified voltage between the first thin film transistor and the second thin film transistor, and storing the amplified voltage in the second storage capacitor as a voltage of the drain electrode of the third thin film transistor when the photocurrent flowing to the second thin film transistor is amplified; and the photocurrent acquisition phase step further comprises releasing the amplified voltage of the second storage capacitor from the source electrode of the third thin film transistor.

10. The driver circuit driving method as claimed in claim 9, wherein after the photocurrent acquisition phase, the method further comprises:

a reset phase step comprising inputting a reset signal to a gate electrode of a fourth thin film transistor and applying the third power voltage to a source electrode of the fourth thin film transistor such that a drain electrode of the fourth thin film transistor pulls down a voltage of the source electrode of the first thin film transistor and the second thin film transistor is in a turn-off status.

11. The driver circuit driving method as claimed in claim 8, wherein after the photocurrent acquisition phase, the method further comprises:

a reset phase step comprising inputting a reset signal to a gate electrode of a fourth thin film transistor and applying the third power voltage to a source electrode of the fourth thin film transistor such that a drain electrode of the fourth thin film transistor pulls down a voltage of the source electrode of the first thin film transistor and the second thin film transistor is in a turn-off status.

12. The driver circuit driving method as claimed in claim 8, wherein the driver circuit further comprises:

a second storage capacitor comprising a terminal connected to the source electrode of the second thin film transistor and a drain electrode of the third thin film transistor and another terminal connected to a ground terminal.

13. The driver circuit driving method as claimed in claim 8, wherein the driver circuit further comprises:

a fourth thin film transistor configured to reset the photocurrent and comprising a gate electrode connected to a reset signal line, a drain electrode connected to the another terminal of the first storage capacitor and the gate electrode of the second thin film transistor, and a source electrode connected to a third power voltage.

14. The driver circuit driving method as claimed in claim 13, wherein the driver circuit further comprises:

a second storage capacitor comprising a terminal connected to the source electrode of the second thin film transistor and the drain electrode of the third thin film transistor and another terminal connected to a ground terminal.

15. The driver circuit driving method as claimed in claim 13, wherein the driver circuit further comprises:

each of the first thin film transistor, the second thin film transistor, the third thin film transistor, and the fourth thin film transistor being one of a low temperature polysilicon thin film transistor, an oxide semiconductor thin film transistor, or an amorphous silicon thin film transistor.

16. The driver circuit driving method as claimed in claim 13, wherein the third power voltage ranges from −10 v to 0 v.

17. The driver circuit driving method as claimed in claim 8, wherein each of the first power voltage and the second power voltage ranges from −20 v to +20 v.

* * * * *